United States Patent [19]

Su et al.

[11] Patent Number: 4,815,737

[45] Date of Patent: Mar. 28, 1989

[54] GAME BALL

[75] Inventors: Dickson Su, Taipei; Rong-Yuan Su, Kaohsiung Hsien; Cheng-I Su, Kaohsiung Hsien; Mai-Lin Su, Kaohsiung Hsien, all of Taiwan

[73] Assignee: Sports International, Inc., Cleveland, Ohio

[21] Appl. No.: 906,818

[22] Filed: Sep. 12, 1986

[51] Int. Cl.[4] ..... A63B 37/12

[52] U.S. Cl. ..... 273/60 R; 273/DIG. 20

[58] Field of Search ..... 273/60 R, 60 A, 60 B, 273/58 A, 58 R, DIG. 20

[56] References Cited

U.S. PATENT DOCUMENTS

| | | | |
|---|---|---|---|
| 646,350 | 3/1900 | Breinl | 273/60 R |
| 732,962 | 7/1903 | Rogers | 273/60 R |
| 777,045 | 12/1904 | Richards | 273/220 |
| 797,654 | 8/1905 | Wingfield | 273/60 R |
| 840,401 | 1/1907 | Upton | 273/58 A |
| 924,696 | 6/1909 | Shibe | 273/60 R |
| 978,250 | 12/1910 | Whitley | 273/60 R |
| 1,277,368 | 9/1918 | Blocksom | 273/60 R |
| 1,550,795 | 8/1925 | Fox | 273/60 R |
| 1,653,893 | 12/1927 | Eden | 273/199 |
| 1,672,174 | 6/1928 | Ruedy | 273/60 R |
| 2,213,479 | 9/1940 | Voit et al. | 273/60 R |
| 2,242,455 | 5/1941 | De Beer | 273/60 R |
| 2,645,487 | 7/1953 | Hawes | 273/60 R |
| 2,743,931 | 5/1956 | Pooley et al. | 273/60 R |
| 2,753,599 | 7/1956 | Pietraszek et al. | 273/60 R |
| 3,927,882 | 12/1975 | Galarza | 273/58 A |
| 3,976,295 | 8/1976 | Heald | 273/60 R |
| 4,065,126 | 12/1977 | Mantz | 273/58 A |
| 4,149,720 | 4/1979 | Heald | 273/60 R |
| 4,150,826 | 4/1979 | Baldorossi et al. | 273/199 R |
| 4,257,598 | 3/1981 | Massino | 273/60 R |
| 4,261,565 | 4/1981 | Massino | 273/60 R |
| 4,367,873 | 1/1983 | Chang et al. | 273/60 R |
| 4,462,589 | 7/1984 | Morgan | 273/60 R |

FOREIGN PATENT DOCUMENTS

| | | | |
|---|---|---|---|
| 471612 | 2/1951 | Canada | 273/60 R |

OTHER PUBLICATIONS

Mushball article, Belvidere Daily Republican, Oct. 21, 1975.

*Primary Examiner*—George J. Marlo

*Attorney, Agent, or Firm*—Fay, Sharpe, Beall, Fagan, Minnich & McKee

[57] ABSTRACT

A composite game ball used for playing baseball, softball, and the like has a core portion including a plurality of cloth pieces, and a bag enclosing the cloth pieces. The core portion is generally spherically shaped. A yarn is wound about the core portion and a thread is subsequently wound about the yarn-wound core portion. A layer of adhesive coats the thread-covered yarn-wound core portion to form a ball body. A cloth cover encases the ball body. The ball has the general appearance, size, shape, and characteristics of the game ball it replaces but is softer and does not travel as far when hit.

10 Claims, 2 Drawing Sheets

GAME BALL

BACKGROUND OF THE INVENTION

The present invention relates to balls used in recreational games such as baseball or softball and the like. More specifically, the present invention relates to a recreational ball that is of the same size but is softer than a conventional baseball and softball.

A standard regulation baseball, sometimes called a hardball, is a composite ball constructed of a cork and rubber core around which yarn is wrapped and a leather cover sewn. The hardness of a regulation baseball has long been recognized by the sporting industry as being dangerous and posing substantial safety problems. A so-called "softball" is in fact essentially a baseball of larger diameter than a regulation baseball. While the density of softballs is less than that of hardballs, softballs are still quite hard and pose safety problems for players, especially younger players. Both regulation baseballs and softballs have a leather cover which combines with the relatively hard or firm construction of the cores of the balls to produce a composite ball that is capable of seriously injuring a player.

Various alternatives to regulation baseballs and softballs, such as balls made from polyurethane foam, rubber, plastic, or the like have been manufactured. These have met with only limited success because the performance characterists of these substitutes have been substantially different from those of the balls that they have sought to replace. Additionally, the durability of such alternative balls has in many cases been less than desirable.

Attempts have previously been made to produce a sturdier composite recreational ball which would yet be safe and sting-free upon impact with a player. Typical of such prior attempts have been balls in which the conventional rubber and cork core of a regulation ball has been replaced by a rolled or folded cloth core that is held together by adhesive or cohesive tape and covered by a double knit polyester cover. In these balls, the combination of lower ball density; core softness, and a polyester cover produces balls that are less damaging when they strike a player.

Another ball construction that has now come into use provides a urethane foam core wrapped with adhesive tape and encased in a nylon cloth covering. Such a ball is said to have durable construction but with limited flight characteristics and is said to be suitable for indoor use while minimizing risk of damage to property or injury to person.

All of these alternate ball constructions, however, require expensive materials and are quite complex to manufacture. The resultant balls are therefore expensive. Various other difficulties have also been experienced with all the conventional replacements to the standard baseball and softball.

Among these are the fact that the abovementioned types of balls are not sturdy and become lumpy or out of round when hit with a bat. Additionally, the tape-wrapped balls mentioned above are unsightly since such wrapping produces noticeable valleys and ridges under their covers instead of a smooth outer surface. These valleys and ridges are visible even through the ball's cloth covering. Also, tape wrapping adversely affects the roll characteristics of the ball somewhat.

Accordingly, it has been considered desirable to develop a new and improved game ball which would overcome the foregoing difficulties and others while providing better and more advantageous overall results.

BRIEF SUMMARY OF THE INVENTION

In accordance with the present invention, a new and improved composite game ball is provided which replaces a conventional ball used for playing baseball, softball, and the like.

More particularly in accordance with the invention, the game ball comprises a core portion which includes a plurality of cloth pieces and an enclosure means for holding the plurality of cloth pieces. The core portion is generally spherically shaped. Yarn is wound about the core portion and thread is wound about the yarn-wound core portion. A layer of adhesive is also provided for coating the thread-wound, yarn-wound core portion to form a ball body. A cloth cover encloses the ball body. The game ball has the general appearance, size, shape, and characteristics of the ball it replaces but is softer and does not travel as far when hit.

In accordance with another aspect of the invention, the enclosure means comprises a bag, which is preferably made from a conventional plastic material.

According to another aspect of the invention, the cloth cover is made from at least one material selected from the group consisting of polyester, nylon, rayon, wool, cotton, and linen.

According to a further aspect of the invention, the cloth cover is made from two figure eight shaped pieces that are secured to each other in a head to waist relationship. Preferably, the pieces are secured to each other by thread.

According to still another aspect of the invention, the second of the figure eight shaped cloth cover pieces has imprinted thereon a solid line extending along its periphery. Preferably, a perimeter of the second cloth piece is on top of and slightly overlaps the perimeter of the first cloth piece.

According to yet another aspect of the invention, the ball serves as a substitute softball which has a circumference of approximately 12 inches.

According to still yet another aspect of the invention, the ball serves as a substitute baseball which weighs approximately three ounces and has a circumference of approximately nine inches.

In accordance with a still further aspect of the invention, the core portion has a diameter that is between approximately 70% to 90% of the diameter of the finished ball.

According to yet still another aspect of the invention, the cloth pieces of the core portion are made from at least one material selected from the group consisting of cotton, linen, wool, polyester, nylon, and rayon.

One advantage of the present invention is the provision of a new and improved composite game ball which replaces a conventional ball used for playing baseball, softball, and the like. The game ball has the general appearance, size, shape, and characteristics of the ball it replaces but is softer and does not travel as far when hit.

Another advantage of the present invention is the provision of a composite game ball which substantially reduces the risk of injury to players and physical damage to property.

Still another advantage of the present invention is the provision of a composite game ball which is quite durable and will retain its shape during repeated use due to its layered construction.

A further advantage of the present invention is the provision of a game ball which is economical and relatively simple to manufacture.

Yet another advantage of the present invention is the provision of a game ball which has limited flight characteristics and is thus suitable for confined areas or indoors while minimizing the risk of damage to property or personal injury.

Still yet another advantage of the present invention is the provision of a game ball which can be used for recreational games of baseball, softball, and the like by players of varying skills without the necessity for protective equipment or gloves.

A still further advantage of the present invention is the provision of a game ball that can be used by children in the game of "T-ball."

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 6:
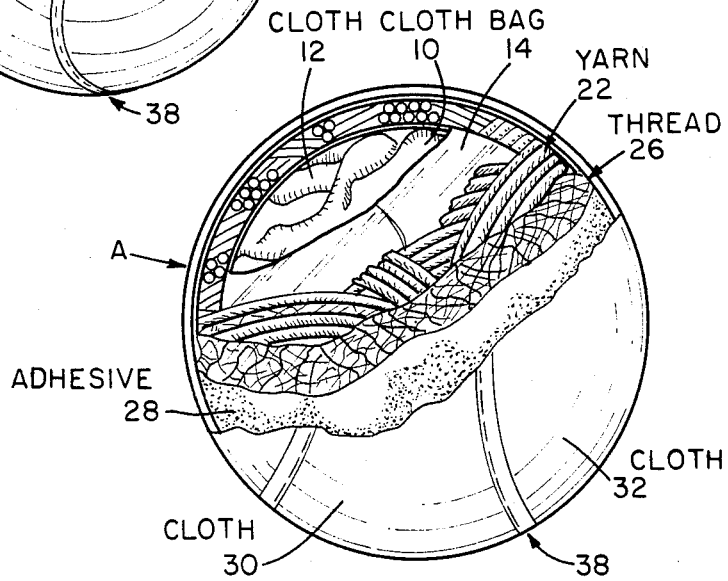

Referring now to the drawings, wherein the showings are for purposes of illustrating a preferred embodiment of the invention only and not for purposes of limiting same, FIG. 6 shows the subject new ball construction A. While the ball construction is primarily designed for and will hereinafter be described as either a baseball or a softball, it will be appreciated that the overall inventive concept could be adapted for use in other game ball environments as well.

Figure 1:
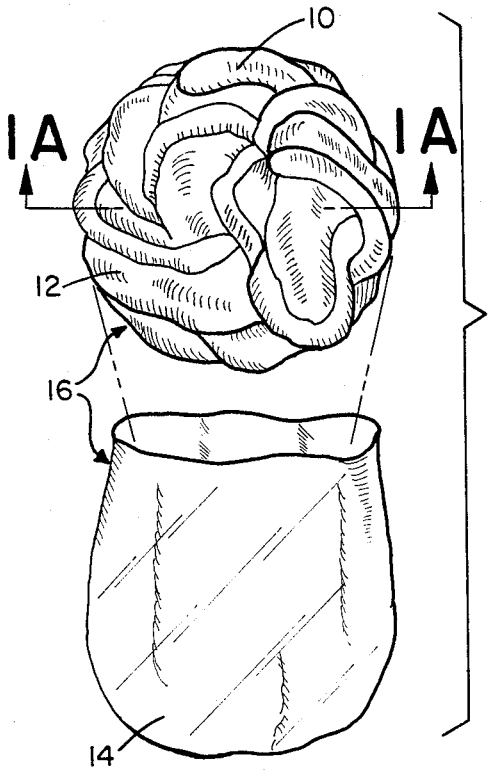
FIG. 1 is a front elevational exploded view of a plurality of wadded up rag pieces and a bag which is meant to enclose them to form a core portion according to a preferred embodiment of the game ball according to the present invention.
Figure 1A:
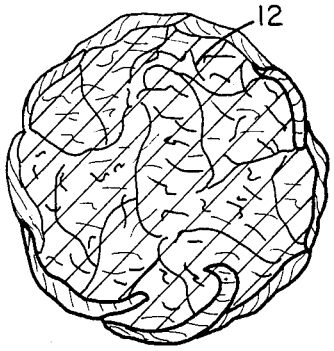
FIG. 1A is a cross-sectional view of a cloth core of the core portion of FIG. 1 along lines 1A—1A.

As shown in FIG. 1, a plurality of rags 10,12 are wadded together and subsequently encased in an enclosure means such as a bag 14 to form the core of the ball. The entire ball core is made from rags 10, 12 as can be seen from the cross-sectional view of FIG. 1A. The cloth pieces can be made from any suitable conventional cloth material such as cotton, linen, wool, polyester, nylon, rayon, and the like or any combination thereof. Basically, the cloth could be any fabric or material formed by weaving, knitting, pressing or felting of natural of synthetic fibers. Since a plurality of cloth pieces can be utilized, inexpensive rags of any suitable size or shape can be placed in the bag 14. The bag enclosed plurality of rags can be readily formed to have an approximately spherical shape. Preferably, the bag 14 is a conventional plastic bag of a type that is readily available. Alternatively, bags made of cloth or other material may also be utilized. Preferably, a core portion 16 so formed comprises approximately 70 to 90% of the diameter of the ball construction A.

Figure 2:
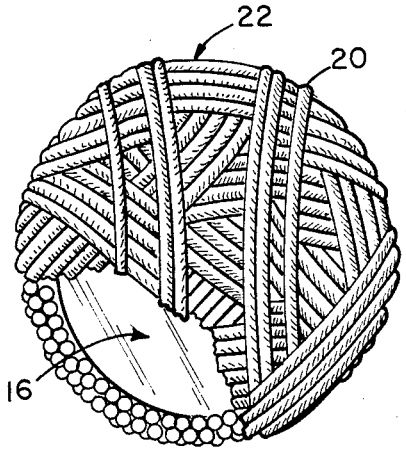
FIG. 2 is a front elevational view, partially broken away, of the core portion of FIG. 1 wound with yarn.
Figure 3:
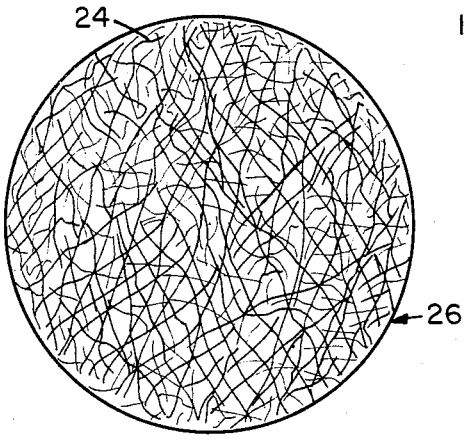
FIG. 3 is a front elevational view of the yarn-wound core portion of FIG. 2 wound with thread.

With reference now to FIG. 2, the core portion 16 of the ball is wrapped with a yarn strand 20. Preferably, several wraps of the yarn strand 20, as illustrated, are provided on the core portion to round the core portion further and prevent it from losing its spherical shape. The several wraps form a yarn wrap layer 22 on the core portion. Preferably, the entire core portion 16 is compressed somewhat by the yarn wrap layer 22.

Subsequently, a thread strand 24 is wrapped around the yarn wrap layer 22. The thread strand is also preferably wrapped several times around the yarn wrap layer 22 to form a thread wrap layer 26. The thread wrap layer encases the yarn-wrapped core to further secure the core in the desired configuration and to further assist in the "rounding" operation.

A core that is as uniform as possible and that is located as close to the exact center of the ball as possible is desired since a ball having an eccentric core or a core of varying weight and/or shape will not bounce true or perform in an accepted manner when thrown or hit.

The thread-wound, yarn-wrapped core portion is then dipped or covered in a glue material or adhesive 28 to prevent the thread from unwrapping or unraveling. Preferably, the adhesive is a rubber cement or the like which is advantageous in that it remains flexible even after it is dry thus being able to better hold the thread to itself when the ball is hit to prevent the thread from unraveling. The correct size of the ball as this stage is obtained by either sizing the thread covered structure with a conventional pattern mold (not illustrated) or by measuring the circumference or the diameter of the ball at this stage.

Figure 4:
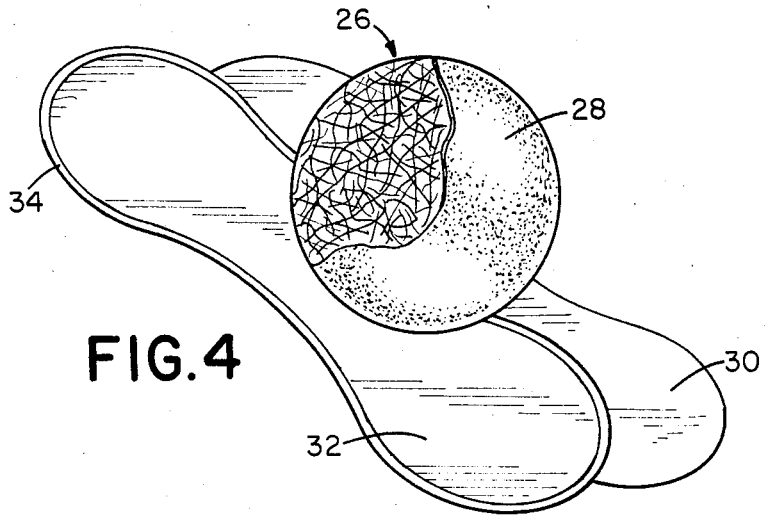
FIG. 4 is a front elevational view, partially broken away of the thread-wound, yarn-wound core portion of FIG. 3 covered by an adhesive layer to form a ball body which rests atop a pair of casing pieces.
Figure 5:
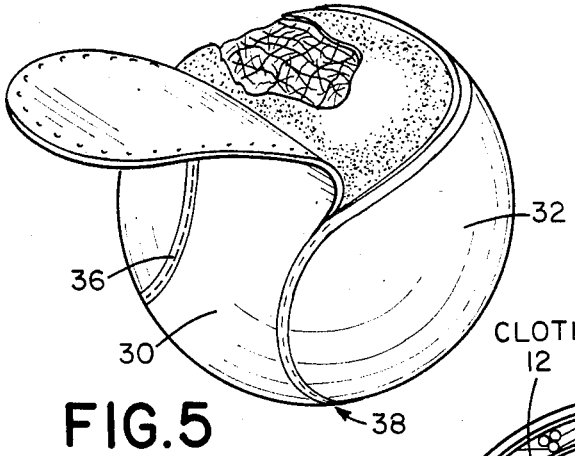
FIG. 5 is a perspective view of the ball body of FIG. 4 stuffed into a partially sewn ball casing; and, FIG. 6 is a front elevational view in partial cut-away of a complete game ball according to the present invention.

A ball body is thus produced which is subsequently encased in a cover as is shown in FIG. 4. The ball body is fairly stiff since the rags 10,12 have been compressed in the core section and the yarn and thread are tightly wound therearound. The cover is preferably prepared by cutting a preferably cloth material into two figure eight shaped pieces 30,32. Preferably, the second cloth piece 32 is provided with a solid border line 34 that is preferably colored. Any suitable method can be used to secure the cover on the ball body. In the preferred embodiment, however, as shown in FIG. 5, the two pieces of cloth 30,32 are partially sewn together by a thread 36 to make a ball casing 38 into which the ball body is stuffed. Afterwards the cover is stitched closed. The thread can be of a suitable conventional material, such as polyester, and is utilized to sew the two figure eight shaped ball casing pieces together around the ball body. The colored border 34 gives the ball casing the distinct figure eight shaped appearance of a conventional baseball or softball.

The cloth of the cover is preferably made from a material such as polyester, nylon, rayon, wool, cotton, linen, or the like or any combination thereof.

With reference now to FIG. 6, it can be seen that the ball of the present invention comprises a plurality of rags 10,12 which are encased in a covering bag 14 that in turn is encased in a yarn layer 22. The yarn in turn is wound with a thread material so as to become encased in a thread layer 26 and the thread layer is subsequently coated with a glue material 28. The ball body thus formed is then enclosed in a cover means comprising a pair of figure eight shaped cover members 30,32.

One advantage of the ball formed in accordance with FIG. 6 is that it better retains its shape than the conventional sting free composite balls, by reason of the large number of concentric layers that form the ball and the stiffness of the ball body. Additionally, the outer layers of the ball of the present invention, i.e. yarn and thread, are very similar to the outer layers of a regulation baseball to form a ball that is sturdy like the conventional regulation baseball.

The ball of the present invention can be utilized as a substitute baseball or a substitute softball or the like. Because the ball does not travel as far when hit, a smaller field can be utilized when the ball is in play. Additionally, because the ball is softer than the conventional baseball there is less danger of physical injury or property damage.

A regulation baseball weighs approximately five ounces (140 grams) and has a circumference of about nine inches (22.9 cm). Various types of softballs are used in the United States ranging from a 10 inch (25.4) circumference to the 16 inch (40.6 cm) circumference ball which enjoys popularity in some areas of the United States. The number of cloth pieces utilized in the center of a ball according to the present invention as well as the size of the closure means or bag would obviously be dependent upon the size of the ball that is meant to be produced. Similarly, the amount of yarn and thread utilized on the ball is dependent upon the size of ball that is meant to be produced. Obviously, the larger the ball the more material it will take to form the ball to the correct size.

One embodiment of a ball constructed according to the present invention, which is meant to replace a conventional baseball, has a circumference of approximately nine inches (22.9 cm) and weighs about 75–80 grams (2.65–2.82 oz).

The subject invention thus provides a method for making a new and useful ball. A ball made according to the method is for use in conventional games of baseball, softball, and the like. The ball can utilize a plurality of inexpensive rag pieces enclosed in a bag as its core portion to reduce its cost of manufacture. Additionally, the ball can withstand a considerable amount of wear and may be used for practice games, catching and pitching drills, and the like. The ball is especially useful in the so-called T-ball type game for small children where the use of a conventional baseball would be dangerous because of the possibility of physical injury to the child.

The invention has been described with reference to a preferred embodiment. Obviously, alterations and modifications will occur to others upon a reading and understanding of this specification. It is intended to include all such modifications and alternations insofar as they come within the scope of the appended claims or the equivalents thereof.

What is claimed is:

1. A composite game ball which replaces a conventional ball used for playing baseball or softball, comprising:

a core portion comprising:
- a plurality of cloth pieces, and
- a bag for holding said plurality of cloth pieces, wherein said bag includes an opening through which said plurality of cloth pieces can be stuffed into said bag and wherein said bag has structural characteristics which enable said cloth pieces held therein to be molded into a substantially spherical form;

yarn wound about said core portion is a manner to compress said core portion;

thread wound about said yarn-wound core portion;

a layer of adhesive which coats said thread-wound, yarn-wound core portion to form a ball body; and, a cover means for enclosing said ball body wherein said game ball has the general appearance, size, shape, and characteristics of the ball it replaces but is softer and does not travel as far when hit, said ball retaining its shape during repeated use.

2. The ball of claim 1 wherein said cover means is a cloth made from at least one material selected from the group consisting of polyester, nylon, rayon, wool, cotton, and linen.

3. The ball of claim 1 wherein said cover means comprises a cloth cover made of two figure-eight shaped pieces that are secured to each other in a head-to-waist relationship.

4. The ball of claim 3 wherein said figure-eight shaped pieces are secured to each other by a thread.

5. The ball of claim 3 wherein at least one of said figure-eight shaped pieces has imprinted thereon a solid line extending along its periphery.

6. The ball of claim 5 wherein the perimeter of said second cloth piece is on top of and slightly overlaps the perimeter of said first cloth piece.

7. The ball claim 1 wherein said adhesive comprises a rubber cement.

8. The ball of claim 1 wherein said ball serves as a substitute baseball which weighs approximately 75–80 grams and has a circumference of approximately 22.9 cm.

9. The ball of claim 1 wherein said core portion has a diameter that is between approximately 70% to 90% of the diameter of the finished ball.

10. The composite ball of claim 1 wherein said core portion cloth pieces are fabricated from at least one material selected from the group consisting of cotton, linen, wool, polyester, nylon, and rayon.

* * * * *